US007543627B2

(12) United States Patent
Shimomura

(10) Patent No.: US 7,543,627 B2
(45) Date of Patent: Jun. 9, 2009

(54) METHOD OF REMOVING MOLDED ARTICLE AND APPARATUS FOR SAME

(75) Inventor: Osamu Shimomura, Toyota (JP)

(73) Assignee: AISIN Takaoka Co. Ltd., Toyota, Aichi Pref. (JP)

( * ) Notice: Subject to any disclaimer, the term of this patent is extended or adjusted under 35 U.S.C. 154(b) by 741 days.

(21) Appl. No.: 11/017,407

(22) Filed: Dec. 17, 2004

(65) Prior Publication Data

US 2005/0140062 A1 Jun. 30, 2005

(30) Foreign Application Priority Data

Dec. 24, 2003 (JP) ..... 2003-426115
Jul. 16, 2004 (JP) ..... 2004-209512

(51) Int. Cl.
*B22C 9/00* (2006.01)
*B22D 29/00* (2006.01)
*B28B 7/10* (2006.01)

(52) U.S. Cl. ..... 164/131; 164/186; 164/213; 164/344; 264/334; 425/441

(58) Field of Classification Search ..... 164/28, 164/44, 131, 137, 180, 186, 200, 213, 228, 164/339, 342, 344, 345; 264/334; 425/441, 425/436 R, 443, 444
See application file for complete search history.

(56) References Cited

U.S. PATENT DOCUMENTS 5,787,957 A * 8/1998 Nagarwalla et al. ..... 164/16
7,037,101 B2 * 5/2006 Krohn et al. ..... 425/525

FOREIGN PATENT DOCUMENTS

| | | |
|---|---|---|
| CN | 2472907 Y | 1/2002 |
| JP | 01-171827 | 7/1989 |
| JP | 09-155935 | 6/1997 |
| JP | 2000-000633 | 1/2000 |
| JP | 2001-150496 | 6/2001 |
| JP | 2002-059466 | 2/2002 |
| JP | 2002-355839 | 12/2002 |

* cited by examiner

*Primary Examiner*—Kuang Lin
(74) *Attorney, Agent, or Firm*—Husch Blackwell Sanders Welsh & Katz

(57) ABSTRACT

A method of removing a molded article, which makes it possible to remove easily said molded article without causing deformation and damages thereto and an apparatus for same. The method comprises removing a sand core W which is obtained using a sand core forming mold 12 comprising a fixed and movable molds 21 and 31 from a sand core forming mold 12 by a separating movable mold 31 from the fixed mold 21 to perform a mold opening. The fixed mold 21 is provided with a fixed mold side core 23 having a front end face 23*a* forming a part of a first molding face 22, which is extendable and retractable in a mold opening direction A1. The movable mold 31 is provided with a movable mold side core 33 having a front end face 33*a* forming a part of a second molding face 32, which is extendable and retractable in a mold opening direction A1. The relation in which the sand core W is held between both cores 23 and 33 is kept by extending both cores 23 and 33 in a mold opening direction A1.

19 Claims, 6 Drawing Sheets

METHOD OF REMOVING MOLDED ARTICLE AND APPARATUS FOR SAME

FIELD OF THE INVENTION

The present invention relates to a method of removing a molded article which is obtained using a forming mold therefrom by conducting a mold opening, and a molding apparatus for same.

BACKGROUND OF THE INVENTION

Various molded articles have heretofore been produced by using molding apparatus each comprising fixed and movable molds. Specifically, a molded article is produced by injecting a molding material into a molding space (cavity) defined by fixed and movable molds. Then, the resultant molded article is removed from the cavity of the forming mold by conducting a mold opening to separate the movable and fixed molds. Since the molded article is adhered to the molding face (cavity face) of at least one of the molds, removing thereof is often difficult. Accordingly, methods of separating and dropping the molded article from the molding face by inserting an eject pin and the like against the molded article in the course of the mold opening have been proposed. Methods of separating the molded article from the molding face and carrying it by gripping and sucking it with devoted carrying apparatus have also been proposed. Methods of separating the molded article from the molding face by inserting an eject pin and the like in the course of the mold opening and thereafter sucking the separated molded article to a carrying unit have been proposed (refer to Patent document 1).

[Patent document 1] Japanese Patent Kokai Publication No.P2001-150496A (FIG. 2)

SUMMARY OF THE DISCLOSURE

The above-mentioned prior art removing methods using an eject pin have a problem in that the molded article is liable to be subjected to deformation and/or damage due to the shock on dropping thereof. The prior art removing method using the carrying unit has a problem in that removal thereof may be difficult depending upon the shape thereof. If the molded article which is difficult to remove is forcedly removed, deformation and damage are liable to be caused on the molded article.

The above-mentioned problems are remarkable if the molded article is fragile (for example, the molded article is formed of sand and the like).

The present invention has been made in view of the above-mentioned problems. It is an object to provide a method which enables molded articles to be easily removed without causing any deformation and/or damage of the molded article. It is another object of the present invention to provide a molding apparatus which is preferable to perform the above-mentioned excellent removing method.

According to Claim 1 in a first aspect of the present invention, there is provided a method of removing a molded article which can be obtained by using first and second molds having a first molding face and a second molding face, respectively, by conducting mold opening for separating the first and second molds from each other. The method comprises: providing a first movable insert member having a front end face forming a part of the first molding face so that the first movable insert member is extendable into or retractable from the first mold; providing a second movable insert member having a front end face forming a part of the second molding face so that the second movable insert member is extendable into or retractable from the second mold; and keeping the molded article to be held between both movable insert members by extending both of the movable insert members relative to the molds in a mold opening direction when the molds are opened.

In accordance with the method of Claim 1, the molded article can be easily removed from the first and second molding faces of the first and second molds by extending the first and second insert members in a mold opening direction upon opening of the mold. Dropping of the molded article can be prevented due to the fact that the molded article is kept to be held between the first and second movable insert members. Even if the molded article is fragile, the molded article can be easily removed from the forming mold without causing any deformation and/or damage thereof.

Specifically, the first and second movable insert members may include a core to form the molded article with a concave or convex, also an eject pin and the like not intended to form the molded article with a concave or convex. If the movable insert member is a core, the molded article is more stably held, so that dropping of the molded article can be positively prevented. The number of the first and second movable insert members is not particularly limited, and may be one or plural.

When both movable insert members are extended in mold opening directions, it is preferable to keep the separation distance between the front end faces of both movable insert members at a constant distance. This enables the front end faces of both movable insert members to be constantly in contact with the surface of the molded article until the mold opening is completed. Thus, the molded article is more stably held, so that the molded article can be positively prevented from being dropped.

According to Claim 2, there is provided a method of removing a molded article according to the first aspect, wherein the lower side of the molded article is supported by a molded article receiving jig and the molded article is released from the both movable insert members by separating both movable insert members from each other under this condition.

In accordance with the invention as set forth in Claim 2, shock is hardly applied to the molded article even when the molded article is transferred to the molded article receiving jig from both movable insert members since the lower side of the molded article has been already supported by the molded article receiving jig. It is not necessary to grip the molded article on transferring if the molded article receiving jig which supports the lower side of the molded article is used. As a result, deformation and/or damage of the molded article can be positively prevented from occurring.

It is preferable that the upper face of the molded article receiving jig has a form which conforms to the surface contour (profile) of the lower side of the molded article. In this case, chipping of the molded article can be prevented more positively.

According to the method as defined in Claim 3, when the molds are opened, the first movable insert member telescopically extends relative to the first mold and the second movable insert member telescopically extends relative to the second mold.

According to the method as defined in Claim 4, when the molds are opened, at least one of the first and second movable insert members extends and retracts parallel to the mold opening direction.

According to the method as defined in Claim 5, when the molds are opened, a distance between the front end face of the first movable insert member and the front end face of the second movable insert member is kept constant.

In a second aspect of the present invention, according to Claim 6, there is provided a molding apparatus including a forming mold assembly comprising first and second molds having a first molding face and a second molding face, respectively, in which the forming mold assembly is opened by separating the first and second molds from each other. The apparatus comprises: a first movable insert member provided on the first mold, the insert member having a front end face forming a part of the first mold, the insert member being extendable from or retractable in a mold opening direction; and a second movable insert member provided on the second mold, having a front end face forming a part of the second mold, the insert member being extendable from or retractable in a mold opening direction; provided that the both movable insert members are structured to be capable of simultaneously performing an extending operation on opening of the molds.

In the apparatus as set forth in Claim 6, the first and second movable insert members are extended from the first and second molding faces of the first and second molds, respectively, upon opening of the mold. Therefore, the first movable insert member is not moved away from the second movable insert member even at opening of the mold. It is possible to keep holding of the molded article during the opening process of the mold. Use of this molding apparatus makes it possible to conduct the method of removing the molded article easily without causing any deformation and/or damage.

According to Claim 7, in a molding apparatus as defined in Claim 6, the apparatus further comprises a molded article receiving jig which is retracted to a position below the first and second molds when the mold is closed and is elevated to a position where it supports the lower side of the molded article when the mold is opened.

Since the molded article receiving jig is retracted to a position below the first and second molds at closing of the mold in the apparatus as set forth in Claim 7, interference between the first and second molds and the molded article receiving jig can be prevented. When the mold is opened, the molded article receiving jig is elevated to a predetermined position where it positively supports the lower side of the molded article and receives it. The molded article receiving jig may be configured to carry the received article to another position.

According to Claim 8, there is provided a molding apparatus as defined in Claim 6, wherein the apparatus comprises a first stop member which is extended or retracted together with the first movable insert member, and a second stop member which is extended or retracted together with the second movable insert member; and in that both stop members are configured so that an abutting relationship between the front end portions of the first and second stop members is kept until the mold opening is completed.

In the apparatus according to Claim 8, approaching of the front end faces of both movable insert members to each other can be prevented due to the fact that the abutting relationship between the front end portions of both stop members is kept until mold opening is completed. Therefore, deformation and/or damage of the molded article due to excessive extension of both movable insert members can be prevented.

According to a third aspect of the present invention, there is provided a method of producing a molded article by removing a molded article which is obtained by using a first mold having a first molding face and a second mold having a second molding face by conducting mold opening for separating the first and second molds from each other. The method comprises: providing a cavity by the first and second molds at a closed state and a first movable insert member having an end face forming a part of the first molding face and a second movable insert member having an end face forming a part of the second molding face, charging a mold material into the cavity for molding, and opening the molds for separating the first and second molds from each other while maintaining a state where the molded article is supported by the first and second movable insert members, whereupon the molded article can be removed.

According to the third aspect, the molded article is prevented from dropping by maintaining the state where the molded article is retained (or held) between the first and second insert members upon opening of the molds. Even if the molded article is fragile, the molded article can be easily removed from the forming mold without causing any deformation and/or damage thereof.

According to the third aspect, the method further comprises: supporting a bottom side of the molded article by a supporting jig when the molds are opened, while the molded article is supported by the first and second movable insert members, and releasing the molded article from both the movable insert members by supporting both the movable insert members from each other in the state that the molded article is supported by the supporting jig.

According to the third aspect, during the opening of the molds, the first movable insert member extends relative to the first mold and the second movable insert member extends relative to the second mold.

According to the third aspect, during the opening of the molds, at least one of the first and second movable insert members extends parallel to a direction of opening and closing of the molds.

According to the third aspect, during the opening of the molds, the end face of the first movable insert member and the end face of the second movable insert member, i.e., abutting faces of both the movable insert members to the molded article, are kept at a constant separated distance.

According to a fourth aspect of the present invention, there is provided a molding apparatus comprising a mold assembly having a first mold with a first molding face and a second mold with a second molding face, in which the molds are opened by separating the first and second molds from each other. The apparatus further comprises: a first movable insert member that is extendable and retractable along a direction of opening and closing of the molds, the first movable insert member being provided in the first mold and having an end face forming a part of the first molding face, a second movable insert member that is extendable and retractable along a direction of opening and closing of the molds, the second movable insert member being provided in the second mold and having an end face forming a part of the second molding face, a mold driving unit for displacing at least one of the first and second molds, and a driving unit for displacing at least one of the first and second movable insert members relative to the first and second molds.

In the fourth aspect, the molded article is supported by both the movable insert members during opening of the molds.

According to the fourth aspect, the molded article can be retained in a supported state between the first and second insert members by means of the driving unit for the first and second movable insert members. This allows easy removal of the molded articles without deformation or fracture.

In the fourth aspect, the driving unit for the movable insert members comprises a device for extending the first movable insert member relative to the first mold, and a device for extending the second movable insert member relative to the second mold.

Also in the fourth aspect, the driving unit for the movable insert members comprises a device for extending and retracting at least one of the first and second movable insert members in parallel with the direction of opening and closing of the molds relative to the first or second mold.

Also in the fourth aspect, the molding apparatus further comprises a supporting jig for supporting the molded article, the jig assuring a retracted position below the first and second molds upon closing the molds, and an elevated position to support a bottom side of the molded article upon opening the molds.

Also in the fourth aspect, the first and second insert members comprise a stopper member or members or a shape that can keep constant a distance between the first and second movable insert members so as to prevent unexpected nearing each other when the molds are opened.

Also in the fourth aspect, the first mold is a fixed mold, and the second mold is a movable mold, the mold driving unit comprises a mold opening/closing mechanism for displacing the second mold, and the driving unit for the movable insert members comprising: an insert member driving device, arranged at the first mold, for extending the first movable insert member from the first mold by moving the first movable insert member in a direction opposite to the first mold when the molds are opened, and an insert member driving device, arranged at the second mold, for extending the second movable insert member from the second mold when the molds are opened.

The meritorious effects of the present invention are summarized as follows.

As mentioned in detail, a method which can easily remove the molded article without any deformation and/or damage can be provided in accordance with the present invention. A molding apparatus which is preferable to conduct the above-mentioned excellent removing method can be provided in accordance with the present invention.

PREFERRED EMBODIMENTS OF THE INVENTION

An embodiment in which the present invention is embodied will now be described in detail with reference to FIGS. 1 through 6.

Figure 1:
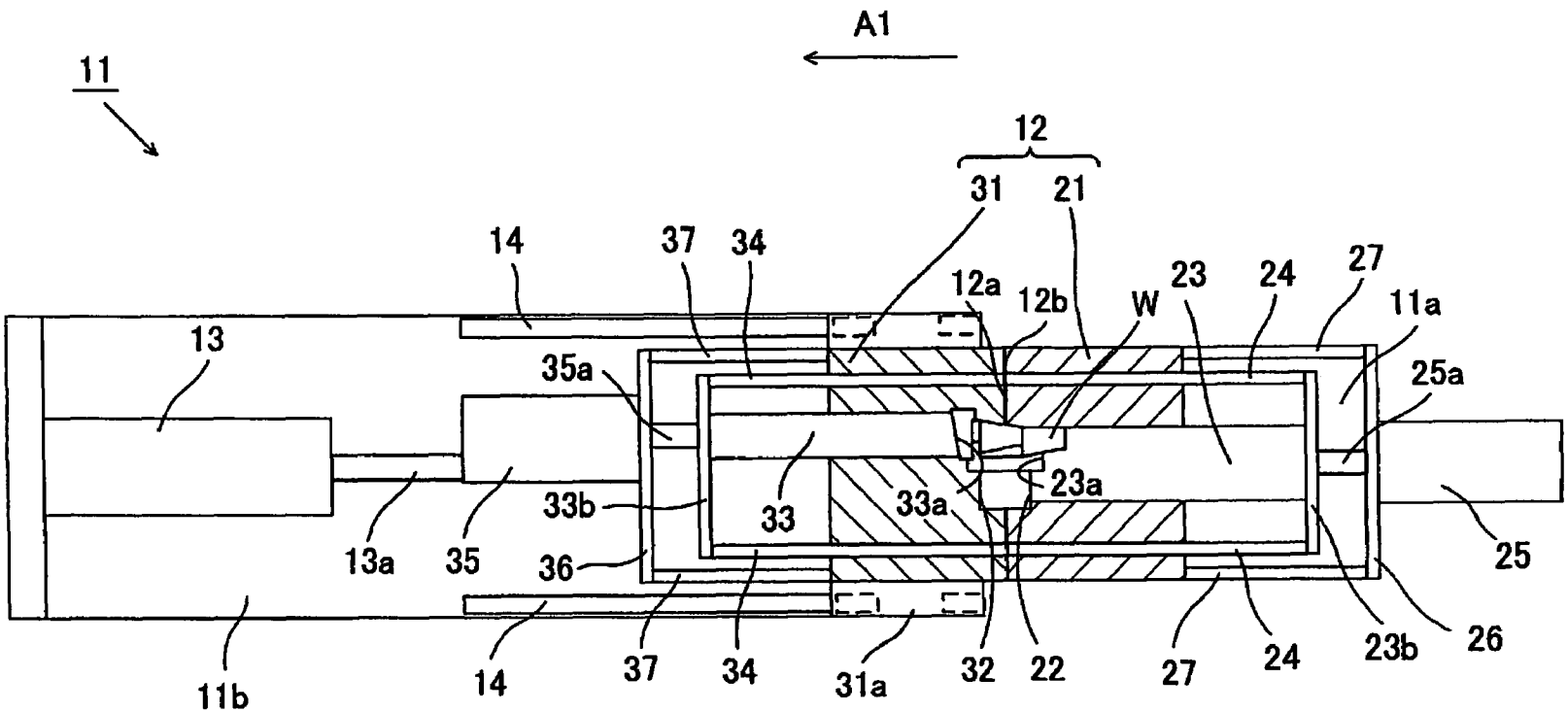
FIG. 1 is a schematic plan view showing a molding apparatus of an embodiment in which the present invention is embodied.
Figure 2:
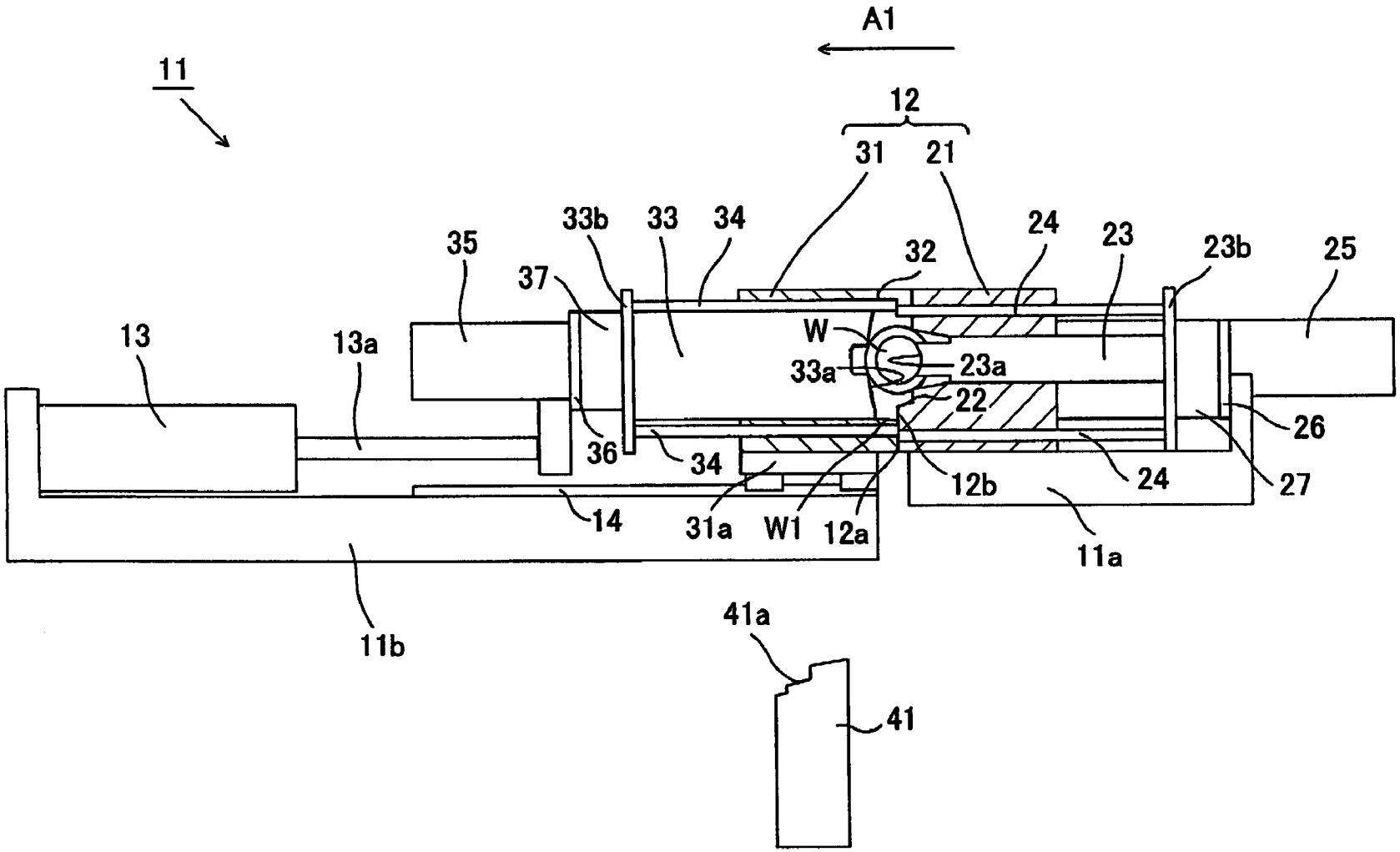
FIG. 2 is a schematic front view showing the apparatus of FIG. 1.
Figure 3:
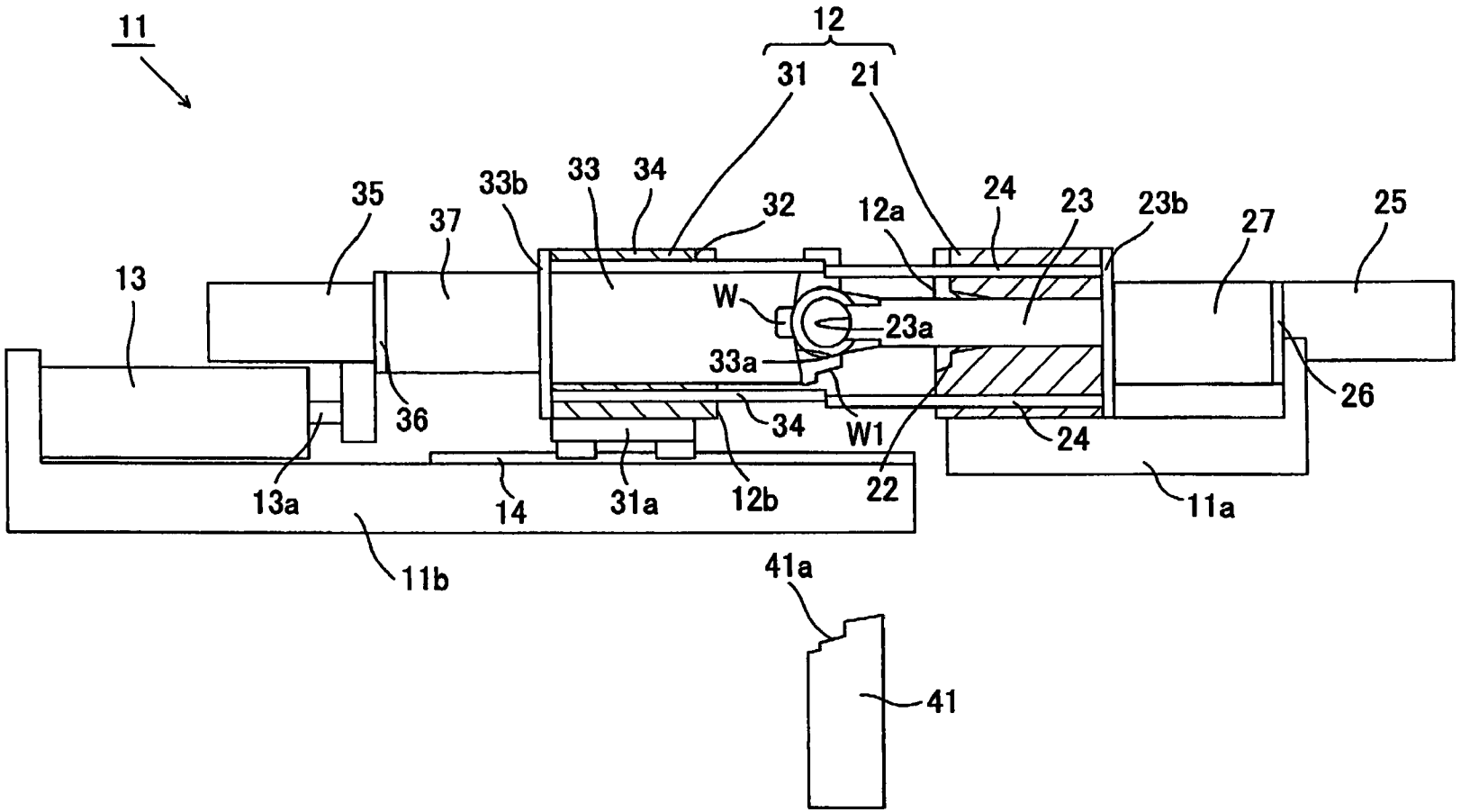
FIG. 3 is a schematic front view explaining molding which is conducted using present molding apparatus.

A sand core molding apparatus 11 (molding apparatus) shown in FIGS. 1 and 2 is an apparatus to mold a sand core W as a molded article by charging sand into a molding space (cavity) within sand core molding mold 12 (forming mold) comprising a fixed mold 21 (first mold) and a movable mold 31 (second mold).

The fixed mold 21 and a cylinder 25 for driving a fixed mold side core (insert member driving unit) are secured on a fixed mold side base 11*a* of the sand core molding apparatus 11. A plate 26 for a first cylinder is secured to the cylinder 25 for driving the fixed mold side core. Base ends of first connecting plates 27 are connected to both sides of the plate 26 for the first cylinder. The front ends of the first connecting plates 27 are connected to the rear end faces of the fixed mold 21. The cylinder 25 for driving the fixed mold side core comprises a rod 25*a* which extends or retracts in a right or left direction in FIG. 1.

As shown in FIGS. 1 and 2, a molding opening and closing cylinder (mold driving unit) 13 which conducts mold closing (mold clamping) by moving the movable mold 31 toward the fixed mold 21 or bringing them into a contact, and mold opening by moving the movable mold 31 away from the fixed mold 21 is secured on a movable mold side base 11*b* of the sand core molding apparatus 11. The mold opening and closing cylinder 13 comprises a rod 13*a* for moving the movable mold 31 in a right or left direction in FIG. 1. A pair of rails 14 extending in a mold opening direction A1 of the movable mold 31 is provided on the movable mold side base 11*b*. A slider 31*a* which is provided under the movable mold 31 is guided on and along the rails 14, so that the movable mold 31 is movable in a mold opening direction A1.

Said sand core forming mold 12 is opened due to the fact that the movable mold 31 is moved in a mold opening direction A1 by the mold opening and closing cylinder 13 so that it is moved away from the fixed mold 21. Parting (splitting) faces 12*a*, 12*b* of the sand core molding molds (mold assembly) 12 are perpendicular to the mold opening direction A1. The parting face 12*a* on the side of the fixed mold 21 is parallel with the parting face 12*b* on the side of the movable mold 31. The parting faces 12*a* and 12*b* may not be perpendicular to the mold opening direction A1. The fixed mold 21 has a first molding face 22 in the parting face 12*a* and the movable mold 31 has a second molding face 32 in the parting face 12*b*. These first and second molding faces 22 and 32 form a cavity of the sand core molding mold 12, when the mold is closed.

As shown in FIGS. 1 and 2, the fixed mold 21 is provided with a fixed mold side core 23 as a first movable insert member and the movable mold 31 is provided with a movable mold side core 33 as a second movable insert member. The fixed and movable mold side cores 23 and 33, respectively, are capable of forming a concave or convex on the sand core W as a molded article.

A first core plate 23*b* which is biased upon the rod 25*a* of the cylinder 25 for driving the fixed mold side core is secured to the base end side of the fixed mold side core (insert member) 23. The front end portion of the fixed mold side core 23 is inserted into the fixed mold 21 upon closing of the mold and its front end face 23*a* forms a part of the first molding face 22. The front end portion of the fixed mold side core 23 is extended beyond the first molding face 22 due to the fact that the first core plate 23*b* is biased by the rod 25*a* when the mold is opened (refer to FIG. 3). The fixed mold side core 23 is extendable or retractable in parallel with a mold opening direction A1.

As shown in FIGS. 1 and 2, a second core plate 33*b* is secured to the base end side of the movable mold side core (insert member) 33. The second core plate 33*b* is moved by the extension or retraction of a rod 35*a* which is provided on a cylinder 35 (insert member driving unit) for driving the movable mold side core. A plate 36 for the second cylinder which is moved together with the rod 13*a* of the mold opening and closing cylinder is secured to the cylinder 35 for driving the movable mold side core. The base ends of second connecting plates 37 are connected to bath sides of the plate 36 for the second cylinder. The front ends of both second connecting plates 37 are connected to the movable mold 31.

The front end portion of the movable mold side core (insert member) 33 is inserted into the movable mold 31 on closing of the mold and its front end face 33*a* forms a part of the second molding face 32. The front end portion of the movable mold side core 33 is extended beyond the second molding face 32 due to the fact that the second core plate 33*b* is biased by the rod 35*a* of the cylinder 35 for driving the movable mold side core on opening of the mold (refer to FIG. 3). At this time, the front end face 23*a* of the fixed mold side core 23 and the front end face 33*a* of the movable mold side core 33 keep an abut condition with the sand core W until the mold opening is completed. The sand core W is kept to be held by the fixed mold side core 23 and the movable mold side core 33. The movable mold side core 33 can be extended or retracted in parallel with the mold opening direction A1.

As shown in FIGS. 1 and 2, two first stop pins 24 (first stop members) are connected to each of both sides of the first core plate 23*b*. Each of the first stop pins 24 extends through the fixed mold 21 in the same direction (that is, the right or left direction in FIG. 1) by the same length. Two second stop pins 34 (second stop members) are connected to each of both sides of the second core plate 33*b*. Each of the second stop pins 34 extends through the movable mold 31 in the same direction (that is, the right or left direction in FIG. 1) by the same length. The front end of the second stop pin 34 can abut upon the front end of the first stop pin 24. The first stop pin 24 may extend beyond or retract from the parting face 12 of the fixed mold 21 in an interlocking manner with the extension or retraction of the fixed mold side core 23. The second stop pin 34 may extend beyond or retract from the parting face 12*b* of the movable mold 31 in an interlocking manner with the extension and retraction of the movable mold side core 33. The second stop pin 34 is capable to guide the movable mold 31 to an appropriate position on closing of the mold. The front end portions of the first and second stop pins 24 and 34 are structured to keep the abutting condition therebetween until the completion of the mold opening. This keeps the separation distance between the front end face 23*a* of the fixed mold side core 23 and the front end face 33*a* of the movable mold side core 33 constant during the mold opening.

As shown in FIG. 2, the sand core molding apparatus 11 comprises a molded article receiving jig (supporting jig) 41 for receiving the sand core W. The molded article receiving jig 41 is stepped on the top face (supporting face 41*a*) thereof so that it conforms to the surface contour (profile) of the lower face W 1 of the sand core W to be supported. The molded article receiving jig 41 can be retracted to a position below the fixed mold 21 and the movable mold 31 by a lifting mechanism (not shown) on closing of the mold. The molded article receiving jig 41 can be elevated to a predetermined position where it supports the lower face WI of the sand core W on completion of the mold opening (refer to FIG. 4).

Now, a process for molding the sand core W using the sand core molding apparatus 11 will be described.

The cavity is defined by the second molding face 32 of the movable mold 31, the first molding face 22 of the fixed mold 21, the front end face 33*a* of the movable mold side core 33 and the front end face 23*a* of the fixed mold side core 23 by fitting the movable mold 31 to the fixed mold 21. Under this condition, the sand core W is formed by filling the cavity with sand (refer to FIGS. 1 and 2). In this case, the sand within cavity is compacted by at least one of the fixed mold side core 23 and the movable mold side core 33.

A process for removing the molded sand core W from the sand core molding mold 12 will be described.

The movable mold 31 is moved from the fixed mold 21 in a mold opening direction A1 at a predetermined speed from a mold closing condition shown in FIG. 2 by driving the mold opening and closing cylinder (mold driving unit) 13. Simultaneously with this, the front end portion of the movable mold side core 33 is extended from the second molding face 32 of the movable mold 31 by driving the cylinder 35 for driving the movable mold side core. This enables the front end face 33*a* of the movable mold side core 33 to keep the abutting relationship between it and the one side of the sand core W. The front end portion of the fixed mold side core 23 is projected from the first molding face 22 of the fixed mold 21 by driving the cylinder 25 for driving the fixed mold side core. This enables the front end face 23*a* of the fixed mold side core 23 to keep an abutting relationship between it and the other side of the sand core W. As a result, the sand core W is separated from the movable mold 31 and the fixed mold 21 and the sand core W is kept to be held between the movable mold side core 33 and the fixed mold side core 23 (refer to FIG. 3). In the present embodiment, the moving speed (V) of the movable mold 31 is equal to the sum of the extending speed (Va) of the fixed mold side core 23 and the extending speed (Vb) of the movable mold side core 33. This enables the sand core W to be continuously held so that the sand core W can be prevented from dropping. The sand core W can be positively removed from the first and second molding faces 22 and 32.

At this time, the front end portions of the first and second stop pins 24 and 34 keep the abutting relationship therebetween. This prevents further moving of the front end face 23*a* of the fixed mold side core 23 which moves together with the first stop pin 24 toward the front end face 33*a* of the movable mold side core 33 which moves together with the second stop pin 34. Therefore, deformation and/or damage of the sand core W due to excessive extension of both insert members 23 and 33 can be prevented.

Figure 4:
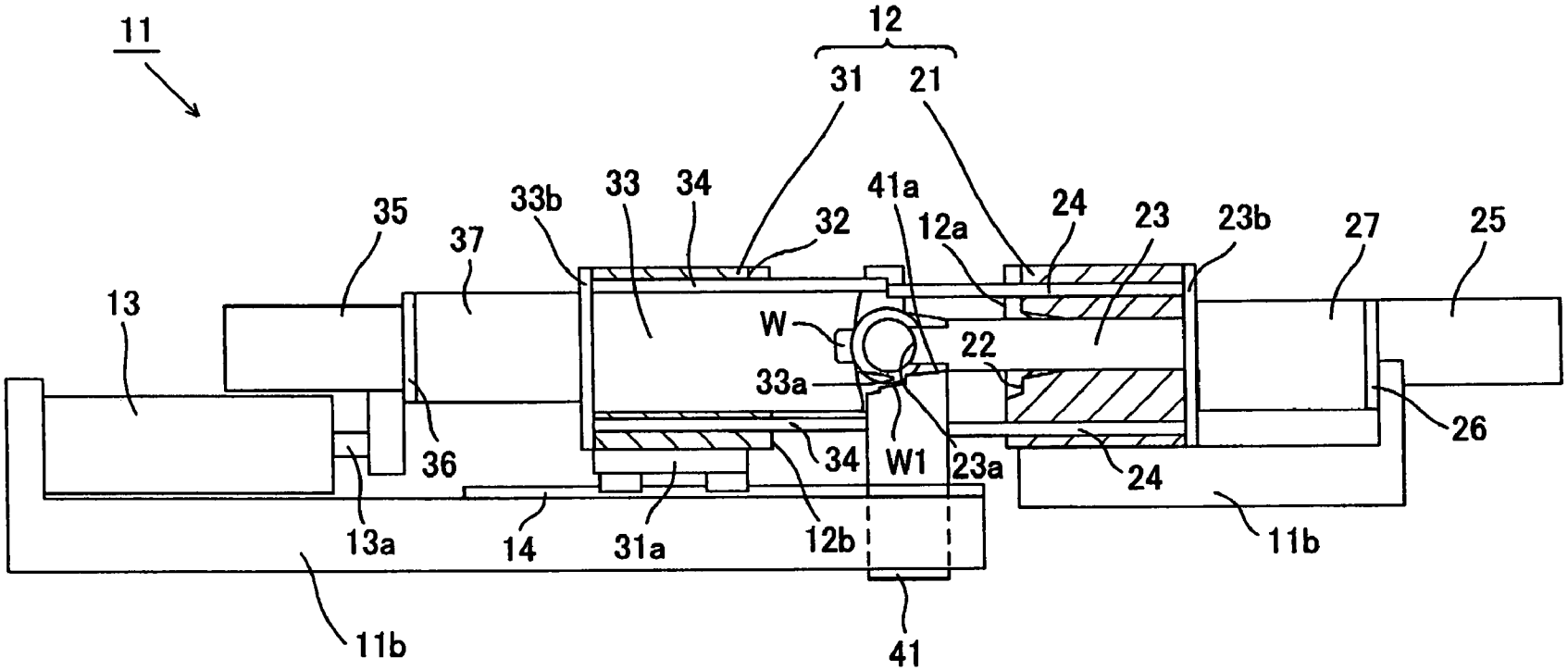
FIG. 4 is a schematic front view explaining molding which is conducted using present molding apparatus.
Figure 5:
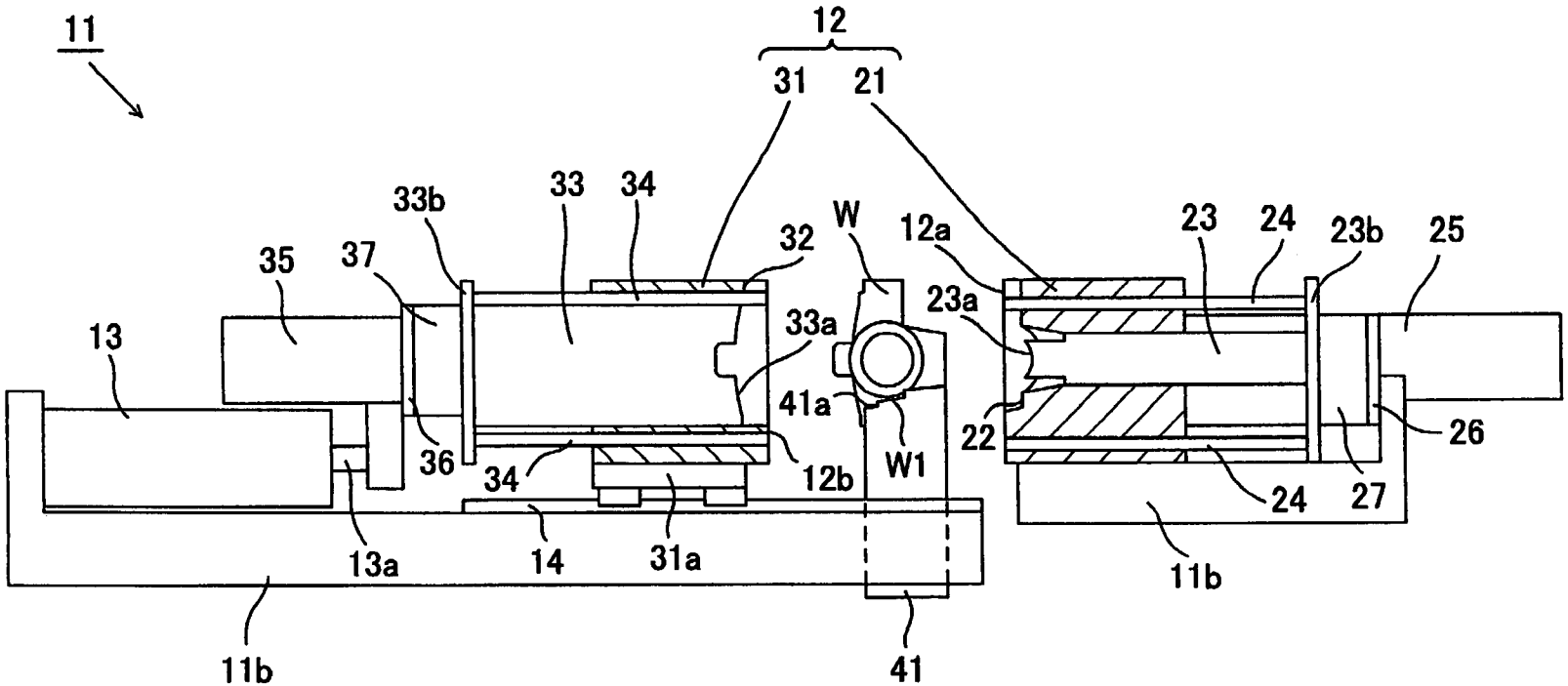
FIG. 5 is a schematic front view explaining molding which is conducted using present molding apparatus.
Figure 6:
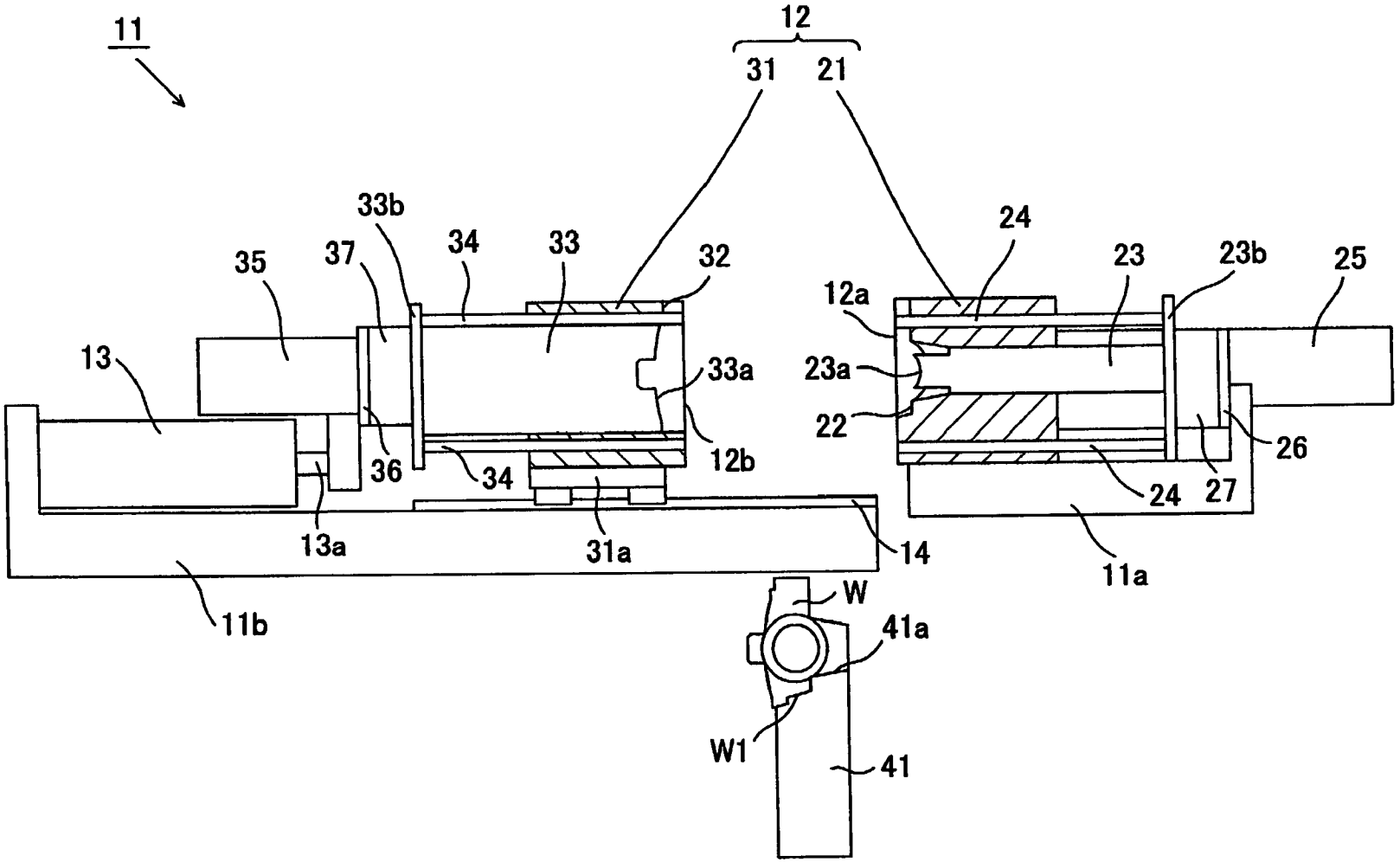
FIG. 6 is a schematic front view explaining molding which is conducted using present molding apparatus.

Then, the molded article receiving jig 41 which has been retracted below is elevated to a predetermined position where it supports the lower face W1 of the sand core W in order to support the sand core W by the supporting face 41*a* of the molded article receiving jig 41 (refer to FIG. 4). The sand core W is released from both insert members 23 and 33 by moving the movable mold side core 33 away from the fixed mold side core 23 under this condition so that the sand core W is transferred on the molded article receiving jig 41 (refer to FIG. 5). The recovery of the sand core W is enabled by lowering the molded article receiving jig 41 to a position below the fixed mold 21 and the movable mold 31 (refer to FIG. 6).

According to the present invention, the following effects can be provided.

(1) In the sand core molding apparatus 11 of the present invention, the sand core W can be easily separated from the first molding face 22 of the fixed mold 21 and the second molding face 32 of the movable mold 31 by extending the fixed mold side core 23 and the movable mold side core 33 in a mold opening direction Al on opening of the mold. Even in this case, an operation for extending the fixed mold side core 23 from the first molding face 22 is performed and an operation for extending the movable mold side core 33 from the second molding face 32 is performed upon opening of the mold. Therefore, dropping of the sand core W is prevented due to the fact that the fixed mold side core 23 is not separated from the movable mold side core 33 and the holding of the sand core W between the fixed mold side core 23 and the movable mold side core 33 is kept. Thus, the sand core W can be easily removed from the sand core forming mold 12 without causing any deformation and/or damage of the sand core W also in a case like the present invention the fragile sand core W is removed.

(2) In the present embodiment, the fixed mold side core 23 and the movable mold side core 33 are fitted to the convex or concave of the sand core W. Therefore, the sand core W is more stably held, so that dropping of the sand core W can be positively prevented on opening of the mold. In addition, since the supporting face 41*a* of the molded article receiving jig 41 is stepped so that it conforms to the surface contour of the lower face W1 of the sand core W, dropping of the sand core W can be prevented when the molded article receiving jig 41 receiving the sand core W and is lowered on opening of the mold. In this case, chipping of the edge portion of the sand core W can be prevented.

(3) In the present embodiment, the fixed mold side core (insert member) 23 and the movable mold side core (insert member) 33 are extendable or retractable in parallel with the mold opening direction A1. Therefore, since arrangement of both cores (insert members) 23 and 33 is easy, the sand core molding apparatus 11 of the present embodiment having both cores (insert members) 23 and 33 can be easily designed. Since the movable mold 31, fixed mold side core 23 and the movable mold side core 33 are moved in parallel with the mold opening direction A1, the movable mold 31 can be moved simultaneously with the movement of both cores 23 and 33. This makes the mold opening easy.

The embodiment of the present invention may be modified as follows:

In the foregoing embodiment, the first and second molds are formed as fixed and movable molds 21 and 31, respectively. Both of the first and second molds may be formed as movable molds.

The embodiment in which the molded article is the sand core W has been described. The molded article may be a cast article (for example, aluminum die cast article) or a resin molded article. The molded article may be in any other shape.

In the foregoing embodiment, deformation and/or damage of the sand core W due to excessive extension of the fixed mold side core 23 and the movable mold side core 33 is prevented by the abutting relation between the front end portions of the first and second stop pins 24 and 34, respectively.

In order to prevent the sand core W from being deformed or damaged, the front end face 23*a* of the fixed mold side core 23 may abut on the front end portion of the second stop pin 34 or the front end face 33*a* of the movable mold side core 33 may abut on the front end portion of the first stop pin 24. Alternatively, the front end face 23*a* of the fixed mold side core 23 may abut on the front end face 33*a* of the movable mold side core 33 to prevent the deformation and/or damage of the sand core W provided that the front end faces 23*a*, 23*a* abut on a portion other than the face for molding the sand core W.

Thus, it is preferable that the fixed mold side core 23 and the movable mold side core 33 comprise a stopper member or a shape to keep constant a distance between the cores 23 and 33 so as to prevent nearing each other when the molds are opened In the foregoing embodiment, the supporting face 41*a* of the molded article receiving jig 41 is stepped so that it conforms to the surface contour of the lower face W1 of the sand core W. Alternatively, the supporting face 41*a* may be flat face on which an elastomer such as sponge is applied.

The sand core forming mold 12 is used as mold in the present embodiment. Metallic mold or resin mold which is used for applications other than molding of the sand core W may be used as a mold.

In addition to the technical concepts as set forth in Claims, technical concepts which are derived from the foregoing embodiments will be described as follows.

(1) In any one of Claims 1 through 20, the parting face of the forming mold is perpendicular to the mold opening direction and the parting face of the forming mold on the side of the first mold is parallel with that of the forming mold on the side of second mold.

(2) In any one of Claims 1 through 20 and the technical concept (1), said first and second molds are fixed and movable, respectively.

(3) In any one of Claims 1 through 20 and the technical concepts (1) and (2), the molded article which is obtained using said forming mold is a sand core.

(4) In any one of Claims 1 through 20 and the technical concepts (1) through (3), the first and second movable insert members are used for forming a concave or convex on the molded article which is obtained using the forming mold.

(5) In any one of Claims 1 through 20 and the technical concepts (1) through (4), the separation distance between the front end faces of the first and second movable insert members is kept constant on the opening of the mold.

(6) In any one of Claims 1 through 20 and the technical concepts (1) through (5), at least one of the first and second movable insert members is extendable and retractable in parallel with the mold opening direction.

(7) A method of producing a molded article in which a molded article obtained by using first and second molds having first and second molding faces, respectively, is removed by conducting a mold opening for separating the first mold from the second mold, is characterized in that the method comprises providing a first movable insert member having a front end face forming a part of the first molding face so that the first movable insert member is extendable into or retractable from the first mold; providing a second movable insert member having a front end face forming a part of the second molding face so that the second movable insert member is extendable into or retractable from the second mold; and keeping the molded article to be held between both movable insert members by extending both of the movable insert members in a mold opening direction when the molds (mold assembly) are opened.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A method of removing a finished molded article which is obtained by using a first mold and a second mold having a first molding face and a second molding face, respectively, by conducting mold opening for separating said first and second molds from each other, wherein said method comprises:

providing a first movable insert member having a front end face forming a part of said first molding face and defining a portion of the finished molded article so that said first movable insert member is extendable into or retractable from said first mold;

providing a second movable insert member having a front end face forming a part of said second molding face and defining a second portion of the finished molded article so that said second movable insert member is extendable into or retractable from said second mold;

the first and second movable insert members comprise a core to form the finished molded article with a concave or convex; and keeping said finished molded article to be held between both movable insert members by extending both of said movable insert members relative to said molds in a mold opening direction when said molds are opened.

2. The method of removing a finished molded article as defined in claim 1, wherein said finished molded article is supported on its lower side by a molded article receiving jig and said finished molded article is released from said both movable insert members by separating both movable insert members from each other under this condition, the upper face of the molded article receiving jig has a form which conforms to the surface contour or profile of the lower side of the finished molded article.

3. The method of removing a finished molded article as defined in claim 1, wherein when said molds are opened, said first movable insert member telescopically extends relative to said first mold and said second movable insert member telescopically extends relative to said second mold.

4. The method of removing a finished molded article as defined in claim 1, wherein when said molds are opened, at least one of said first and second movable insert members extends and retracts parallel to the mold opening direction and a mold closing direction.

5. The method of removing a finished molded article as defined in claim 1, wherein when said molds are opened, a distance between the front end face of said first movable insert member and the front end face of said second movable insert member is kept constant.

6. A molding apparatus including a forming mold assembly comprising first and second molds having a first molding face and a second molding face, respectively, in which said forming mold assembly is opened by separating said first and second molds from each other, wherein said apparatus comprises:

a first movable insert member provided on said first mold, said insert member having a front end face forming a part of said first molding face and defining a portion of a finished molded article, said insert member being extendable from or retractable in a mold opening direction and a mold closing direction;

a second movable insert member provided on said second mold, having a front end face forming a part of said second molding face and defining a second portion of the finished molded article, said insert member being extendable from or retractable in a mold opening direction and a mold closing direction; and the first and second movable insert members comprise a core to form the finished molded article with a concave or convex;

provided that said both movable insert members are structured to be capable of simultaneously performing an extending operation on opening of said molds.

7. The molding apparatus as defined in claim 6, wherein said apparatus further comprises a molded article receiving jig which is retracted to a position below said first and second molds when the molds are closed, said jig being elevated to a position for supporting the lower side of said finished molded article when the molds are opened, the upper face of the molded article receiving jig has a form which conforms to the surface contour or profile of the lower side of the finished molded article.

8. The molding apparatus as defined in claim 6, wherein said apparatus comprises: a first stop member which is extended or retracted together with said first movable insert member; and a second stop member which is extended or retracted together with said second movable insert member;

provided that both the stop members are configured so as to establish and keep an abutting relationship between the front end portions of said first and second stop members until the mold opening is completed.

9. A method of producing a finished molded article by removing a molded article which is obtained by using a first mold having a first molding face and a second mold having a second molding face by conducting mold opening for separating said first and second molds from each other, wherein said method comprises:

providing a cavity by said first and second molds at a closed state and a first movable insert member having an end face forming a part of the first molding face and defining a portion of the finished molded article and a second movable insert member having an end face forming a part of the second molding face and defining a second portion of the finished molded article, and the first and second movable insert members comprise a core to form the finished molded article with a concave or convex, charging a mold material into the cavity for molding, and opening said molds for separating said first and second molds from each other while maintaining a state where said finished molded article is supported by said first and second movable insert members, whereupon said finished molded article can be removed.

10. The method as defined claim 9, wherein the method further comprises: supporting a bottom side of said finished molded article by a supporting jig when said molds are opened, while said finished molded article is supported by said first and second movable insert members, and releasing said finished molded article from both said movable insert members in the state that said finished molded article is supported by said supporting jig, the upper face of the molded article receiving jig has a form which conforms to the surface contour or profile of the lower side of the finished molded article.

11. The method as defined in claim 9, wherein during said opening of the molds, the first movable insert member extends relative to the first mold and the second movable insert member extends relative to the second mold.

12. The method as defined in claim 9, wherein during said opening of the molds, at least one of the first and second movable insert members extends parallel to a direction of opening and closing of the molds.

13. The method as defined in claim 9, wherein during said opening of the molds, the end face of the first movable insert member and the end face of the second movable insert member, i.e., abutting faces of both the movable insert members to the molded article, are kept at a constant separated distance.

14. A molding apparatus comprising a mold assembly having a first mold with a first molding face and a second mold with a second molding face, in which the molds are opened by separating said first and second molds from each other, said apparatus further comprising:

a first movable insert member that is extendable and retractable along a direction of opening and closing of the molds, said first movable insert member being provided in the first mold and having an end face forming a part of the first molding face and defining a portion of a finished molded article, a second movable insert member that is extendable and retractable along a direction of opening and closing of the molds, said second movable insert member being provided in the second mold and having an end face forming a part of the second molding face and defining a portion of the finished molded article, a mold driving unit for displacing at least one of the first and second molds, and a driving unit for displacing at least one of the first and second movable insert members relative to said first and second molds, and the first and second movable insert members comprise a core to form the finished molded article with a concave or convex, wherein said finished molded article is supported by both the movable insert members during opening of the molds.

15. The molding apparatus as defined in claim 14, wherein said driving unit for the movable insert members comprises a device for extending the first movable insert member relative to the first mold, and a device for extending the second movable insert member relative to the second mold.

16. The molding apparatus as defined in claim 14, wherein said driving unit for the movable insert members comprises a device for extending and retracting at least one of the first and second movable insert members in parallel with the direction of opening and closing of the molds relative to the first or second mold.

17. The molding apparatus as defined in claim 14, further comprising a supporting jig for supporting said finished molded article, said jig assuring a retracted position below the first and second molds upon closing the molds, and an elevated position to support a bottom side of said finished molded article upon opening the molds, the upper face of the molded article receiving jig has a form which conforms to the surface contour or profile of the lower side of the finished molded article.

18. The molding apparatus as defined in claim 14, wherein said first and second insert members comprise a stopper member or members or a shape that can keep constant a distance between the first and second movable insert members so as to prevent unexpected nearing each other when the molds are opened.

19. The molding apparatus as defined in claim 14, wherein the first mold is a fixed mold, and the second mold is a movable mold, said mold driving unit comprises a mold opening/closing mechanism for displacing the second mold, and said driving unit for the movable insert members comprises: an insert member driving device, arranged at the first mold, for extending the first movable insert member from the first mold by moving the first movable insert member in a direction opposite to the first mold when the molds are opened, and another insert member driving device, arranged at the second mold, for extending the second movable insert member from the second mold when the molds are opened.

* * * * *